US010096297B2

(12) United States Patent
Nakayama et al.

(10) Patent No.: US 10,096,297 B2
(45) Date of Patent: Oct. 9, 2018

(54) DISPLAY DEVICE, DISPLAY PANEL DRIVER, AND IMAGE DATA SIGNAL TRANSMISSION METHOD

(71) Applicant: LAPIS Semiconductor Co., Ltd., Yokohama (JP)

(72) Inventors: Akira Nakayama, Yokohama (JP); Atsushi Takahashi, Yokohama (JP)

(73) Assignee: LAPIS Semiconductor Co., Ltd., Yokohama (JP)

( * ) Notice: Subject to any disclaimer, the term of this patent is extended or adjusted under 35 U.S.C. 154(b) by 398 days.

(21) Appl. No.: 14/848,122

(22) Filed: Sep. 8, 2015

(65) Prior Publication Data

US 2016/0071472 A1 Mar. 10, 2016

(30) Foreign Application Priority Data

Sep. 9, 2014 (JP) ..... 2014-183067

(51) Int. Cl.
*G09G 3/36* (2006.01)
*G09G 5/00* (2006.01)

(52) U.S. Cl.
CPC ..... *G09G 5/008* (2013.01); *G09G 3/3611* (2013.01); *G09G 2370/08* (2013.01)

(58) Field of Classification Search
CPC .. G09G 5/008; G09G 3/3611; G09G 2370/08; G09G 3/36; G06K 1/00; G06K 2207/00; G06T 1/00; G06T 2200/00
See application file for complete search history.

(56) References Cited

U.S. PATENT DOCUMENTS 6,463,092 B1 * 10/2002 Kim ..... G09G 5/006 370/284
2009/0167750 A1 * 7/2009 Hong ..... G09G 3/2096 345/213
2010/0309173 A1 * 12/2010 Matsuda ..... G09G 3/3674 345/204

FOREIGN PATENT DOCUMENTS

JP 2009-163239 A 7/2009
JP 2011-513790 A 4/2011
JP 2011-221487 A 11/2011

* cited by examiner

*Primary Examiner* — Jarurat Suteerawongsa
(74) *Attorney, Agent, or Firm* — Rabin & Berdo, P.C.

(57) ABSTRACT

For each unit transmission block having a pixel data block including at least one pixel data piece, clock data is added contiguously to a head of the pixel data block. If no data transition has occurred at a boundary between the clock data and the pixel data block, logic inversion is performed on the pixel data piece. Thereafter, a transmission image data signal in which unit transmission blocks, each constituted by adding an inversion flag immediately before the clock data, are consecutively arranged is transmitted to a display panel driver. The driver generates a clock signal on the basis of the clock data included in the received signal and takes in the pixel data piece or the resultant obtained by inverting the logic level of this pixel data piece in accordance with the clock signal on the basis of the inversion flag.

17 Claims, 13 Drawing Sheets

DISPLAY DEVICE, DISPLAY PANEL DRIVER, AND IMAGE DATA SIGNAL TRANSMISSION METHOD

BACKGROUND OF THE INVENTION

1. Field of the Invention

The present invention relates to a display device, a driver for driving a display panel, and an image data signal transmission method for transmitting image data to a driver in a display device.

2. Description of the Related Art

A liquid crystal display device, as a display device, includes: a liquid crystal display panel; a plurality of drivers for driving the liquid crystal display panel; and a control unit for sending out image data to each of the drivers. In recent years, liquid crystal display panels have had increasingly higher resolution in order to display increasingly higher definition images. The transmission frequency of image data has been increasing accordingly. As a result, electro-magnetic interference, what is called EMI, is generated upon the transmission of such image data, thereby destabilizing the driving of the liquid crystal display panel.

In order to suppress adverse effects due to the EMI generated along with a higher frequency of image data, driving methods each employing a PPDS (point to point differential signaling) transmission method according to which image data including clock information inserted therein is transmitted to each driver have been proposed (see Japanese Patent Application Laid-open No. 2009-163239, Japanese Translation of PCT International Application Publication No. 2011-513790, and Japanese Patent Application Laid-open No. 2011-221487, for example).

In order to enable each driver to recognize such clock information out of the image data, data for clock recognition needs to be inserted for each unit block of image data. This cause a bottleneck for high-speed processing.

SUMMARY OF THE INVENTION

It is an object of the present invention to provide a display device, a display panel driver, and an image data signal transmission method capable of transmitting image data at high speed in the display device.

One aspect of the present invention is a display device for displaying an image on the basis of input image data including a sequence of pixel data pieces each indicating a luminance level of a pixel, including: a driver for applying pixel driving voltages to a plurality of data lines formed in a display panel; and a control unit for generating a transmission image data signal in which unit transmission blocks, each having a pixel data block including at least one of the pixel data pieces in the sequence of the pixel data pieces in the input image data, are consecutively or contiguously arranged and transmitting the transmission image data signal to the driver. The control unit includes: a first processing unit for adding clock data contiguously to a head of the pixel data block for each of the unit transmission blocks; a second processing unit for determining whether data transition has occurred at a boundary between the clock data and the pixel data block; a third processing unit for inverting a logic level of the pixel data piece included in the pixel data block if it is determined that the data transition has not occurred; and a fourth processing unit for adding an inversion flag that indicates whether logic level inversion processing has been performed on the pixel data piece included in the pixel data block immediately before the clock data. The driver includes: a clock generating unit for generating a clock signal phase-synchronized with a rear edge of the clock data included in the transmission image data signal received; a data take-in unit for taking in and outputting resultant obtained by inverting a logic level of the pixel data piece included in the transmission image data signal received in accordance with the clock signal if the inversion flag included in the transmission image data signal received indicates that the inversion processing has been performed, and taking in and outputting the pixel data piece in accordance with the clock signal if the inversion flag indicates that the inversion processing has not been performed; and a gradation voltage generating unit for converting the pixel data pieces output from the data take-in unit to the pixel driving voltages.

Another aspect of the present invention is a display panel driver for receiving an image data signal in which unit transmission blocks, each having a pixel data block including at least one pixel data piece indicating a luminance level of a pixel, are consecutively arranged and driving a display panel on the basis of the image data signal received. Clock data is added contiguously to a head of the pixel data block in each of the unit transmission blocks, and an inversion flag that indicates whether logic level inversion processing has been performed on the pixel data piece is added immediately before the clock data. The driver includes: a clock generating unit for generating a clock signal phase-synchronized with the clock data included in the image data signal received; a data take-in unit for taking in and outputting resultant obtained by inverting a logic level of the pixel data piece included in the image data signal received in accordance with the clock signal if the inversion flag included in the image data signal received indicates that the inversion processing has been performed, and taking in and outputting the pixel data piece in accordance with the clock signal if the inversion flag indicates that the inversion processing has not been performed; and a gradation voltage generating unit for converting the pixel data pieces output from the data take-in unit to pixel driving voltages and applying the pixel driving voltages to a plurality of data lines in the display panel.

Still another aspect of the present invention is an image data signal transmission method for transmitting a transmission image data signal to a display panel driver on the basis of input image data including a sequence of pixel data pieces indicating a luminance level of a pixel, including: a first step of determining, for each unit transmission block including a pixel data block including at least one of the pixel data pieces in the sequence of the pixel data pieces in the input image data and clock data contiguously added to a head of the pixel data block, whether data transition has occurred at a boundary between the clock data and the pixel data block; a second step of inverting a logic level of the pixel data piece included in the pixel data block if it is determined that the data transition has not occurred; a third step of adding an inversion flag immediately before the clock data, the inversion flag indicating whether logic level inversion processing has been performed on the pixel data piece included in the pixel data block; and a fourth step of transmitting the transmission image data signal in which the unit transmission blocks are consecutively arranged to the display panel driver.

According to the present invention, in transmitting the image data signal on which the clock data is superimposed to the display panel driver, for each unit transmission block having the pixel data block including the at least one pixel data piece, the inversion flag and the clock data are added immediately before the pixel data block. If no data transition has occurred at the boundary between the clock data and the pixel data block, the logic level of the pixel data piece is inverted and information which indicates whether the inversion processing has been performed on the pixel data piece is set as the inversion flag. This causes the rear edge for clock recognition to always appear at the boundary between the clock data and the head of the pixel data block and allows the driver on a receiver side to restore the original pixel data piece on the basis of the inversion flag.

Thus, according to the present invention, the image data signal on which the clock data is superimposed can be transmitted at high speed since it is only necessary to add, for each unit transmission block, the inversion flag and the clock data each for a 1-bit period.

DETAILED DESCRIPTION OF THE EMBODIMENTS

Figure 1:
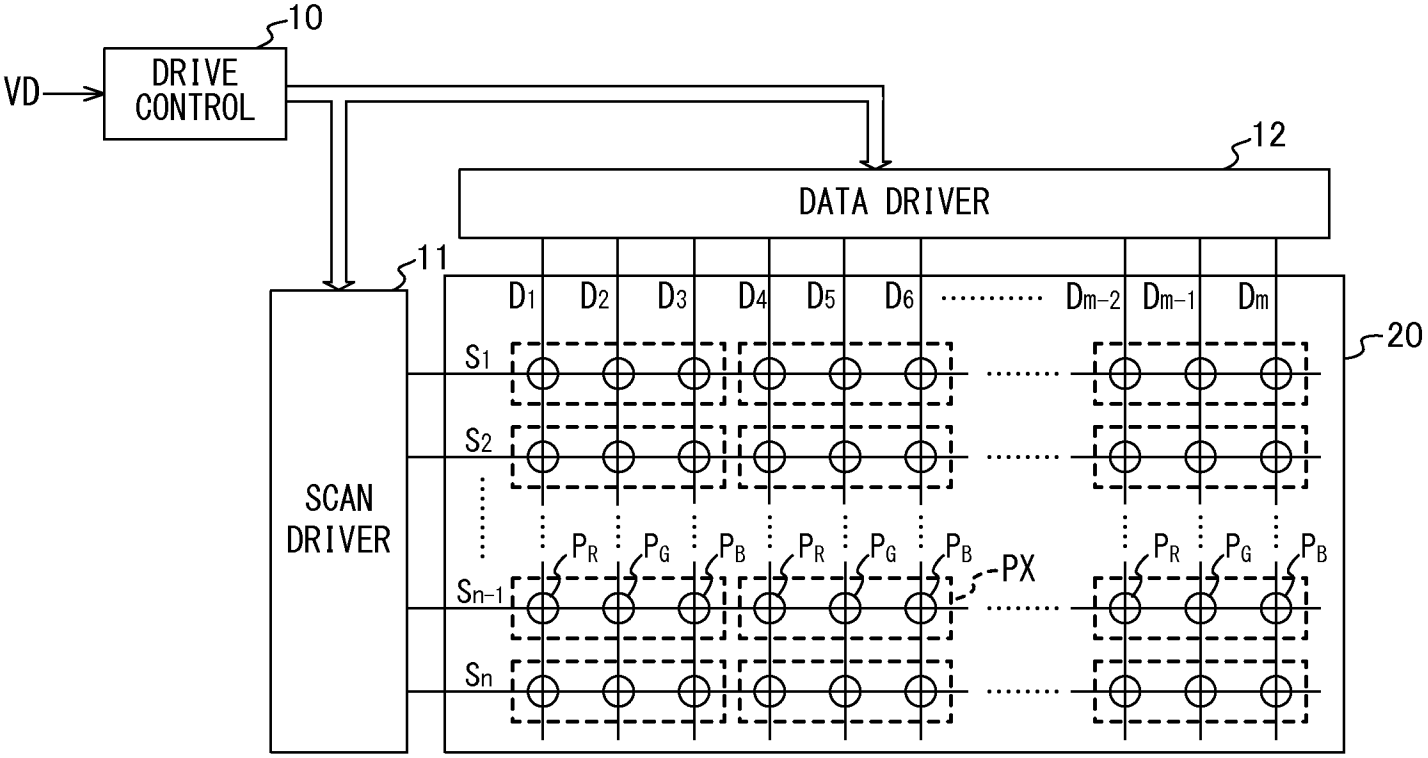
FIG. 1 is a diagram illustrating a schematic configuration of a display device according to the present invention.

FIG. 1 is a diagram illustrating a schematic configuration of a display device according to the present invention.

In FIG. 1, a display panel 20, e.g., a liquid crystal panel includes: a liquid crystal layer (not shown); n (n is an integer larger than or equal to 2) horizontal scanning lines $S_1$ to $S_n$ each extending in a horizontal direction of a two-dimensional screen; and m (m is an integer larger than or equal to 2) data lines $D_1$ to $D_m$ each extending in a vertical direction of the two-dimensional screen. A red display cell $P_R$ for performing red display, a green display cell $P_G$ for performing green display, or a blue display cell $P_B$ for performing blue display is formed at a region where one horizontal scanning line and one data line are intersecting with each other. Among the data lines $D_1$ to $D_m$, the red display cells $P_R$ are formed in the (3·t−2)th data lines (t is a natural number), i.e., $D_1$, $D_4$, $D_7$, . . . , and $D_{m-2}$. Among the data lines $D_1$ to $D_m$, the green display cells $P_G$ are formed in the (3·t−1)th data lines, i.e., $D_2$, $D_5$, $D_8$, . . . , and $D_{m-1}$. Among the data lines $D_1$ to $D_m$, the blue display cells $P_B$ are formed in the (3·t)th data lines, i.e., $D_3$, $D_6$, $D_9$, . . . , and $D_m$.

As shown in FIG. 1, on each of the horizontal scanning lines $S_1$ to $S_n$ three display cells adjacent to one another, i.e., the red display cell $P_R$, the green display cell $P_G$, and the blue display cell $P_B$, together form one pixel PX (a region defined by a broken line). The (m/3) pixels PX are arranged side by side on one horizontal scanning line.

A drive control unit 10 generates a scanning control signal synchronized with input image data VD and supplies the scanning control signal to a scan driver 11.

Figure 2:
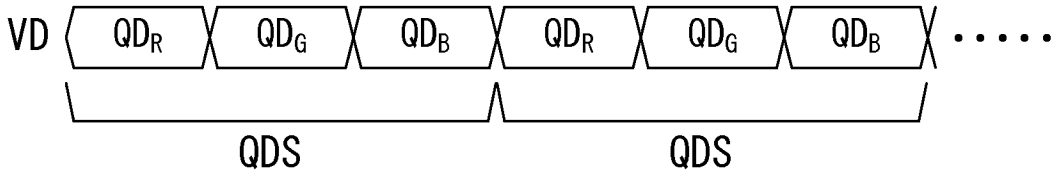
FIG. 2 is a diagram illustrating an example of a format of input image data VD.

As shown in FIG. 2, the input image data VD is formed by sequences of pixel data QD each indicating a luminance level of a pixel. Pixel data $QD_R$ indicating a luminance level of a red component by 8 bits, for example, pixel data $QD_G$ indicating a luminance level of a green component by 8 bits, for example, and pixel data $QD_B$ indicating a luminance level of a blue component by 8 bits, for example, correspond to one pixel PX. The input image data VD includes a sequence of pixel data blocks QDS each containing pixel data $QD_R$, $QD_G$, and $QD_B$ as shown in FIG. 2.

Figure 3:
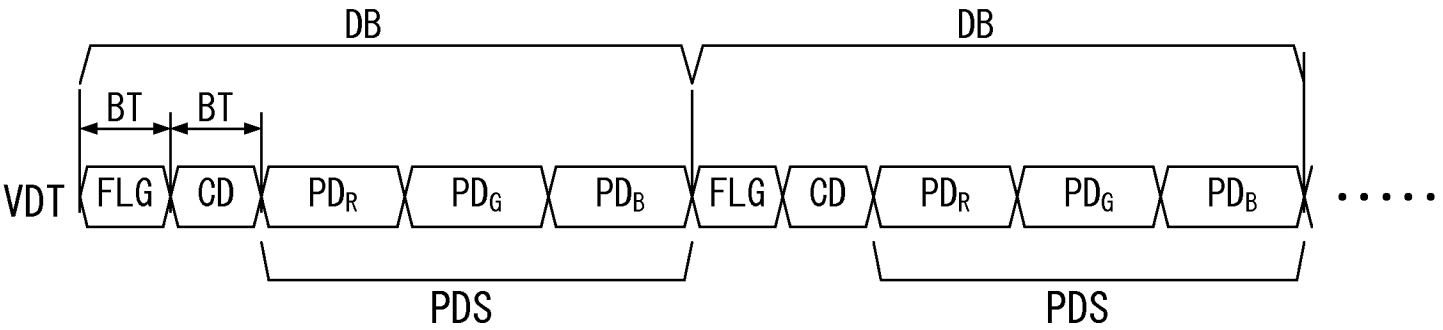
FIG. 3 is a diagram illustrating an example of a format of a transmission image data signal VDT.

On the basis of the input image data VD, the drive control unit 10 generates a transmission image data signal VDT in a 1-bit serial form having a data format shown in FIG. 3. The drive control unit 10 transmits the transmission image data signal VDT to a data driver 12.

As shown in FIG. 3, the transmission image data signal VDT is constituted by a sequence of unit transmission blocks DB each containing an inversion flag FLG, clock data CD, pixel data $PD_R$, pixel data $PD_G$, and pixel data $PD_B$.

The pixel data $PD_R$, $PD_G$, and $PD_B$ respectively indicate luminance levels of red, green, and blue components corresponding to one pixel PX by 8 bits, for example. The pixel data $PD_R$, $PD_G$, and $PD_B$ correspond to the pixel data $QD_R$, $QD_G$, and $QD_B$ in the input image data VD. As shown in FIG. 3, one unit transmission block DB includes a pixel data block PDS constituted by a sequence of the pixel data $PD_R$, $PD_G$, and $PD_B$ corresponding to one pixel. Although the pixel data $PD_R$ is positioned at the head in the pixel data block PDS in an example shown in FIG. 3, the pixel data $PD_G$ or $PD_B$ may be positioned at the head.

The clock data CD is provided to be consecutively coupled to the head of the pixel data block PDS. The clock data CD is formed by a pulse of a 1-bit period BT used for recognizing clock timing in the data driver 12. This pulse may be a negative pulse at a logic level 0 having a rear edge where its logic level is transitioned from 0 to 1, or a positive pulse at a logic level 1 having a rear edge where its logic level is transitioned from 1 to 0.

The inversion flag FLG is provided immediately before the clock data CD. The inversion flag FLG is a flag of the 1-bit period BT indicating whether each pixel data ($PD_R$, $PD_G$, and $PD_B$) in the pixel data block PDS included in the unit transmission block DB to which the inversion flag FLG belongs has been subjected to logic level inversion processing. For example, if the inversion flag FLG indicates the logic level 0, the logic levels of the pixel data ($PD_R$, $PD_G$, and $PD_B$) in the pixel data block PDS are identical to the logic levels of the pixel data ($QD_R$, $QD_G$, and $QD_B$) in the input image data VD. If the inversion flag FLG indicates the logic level 1, on the other hand, the logic levels of the pixel data ($PD_R$, $PD_G$, and $PD_B$) in the pixel data block PDS are those obtained by inverting the logic levels of the pixel data ($QD_R$, $QD_G$, and $QD_B$) in the input image data VD.

The scan driver 11 generates a scan pulse according to the scanning control signal supplied by the drive control unit 10. The scan driver 11 then applies the scan pulse to the horizontal scanning lines $S_1$ to $S_n$ of the display panel 20 in a sequential and alternative manner.

Figure 4:
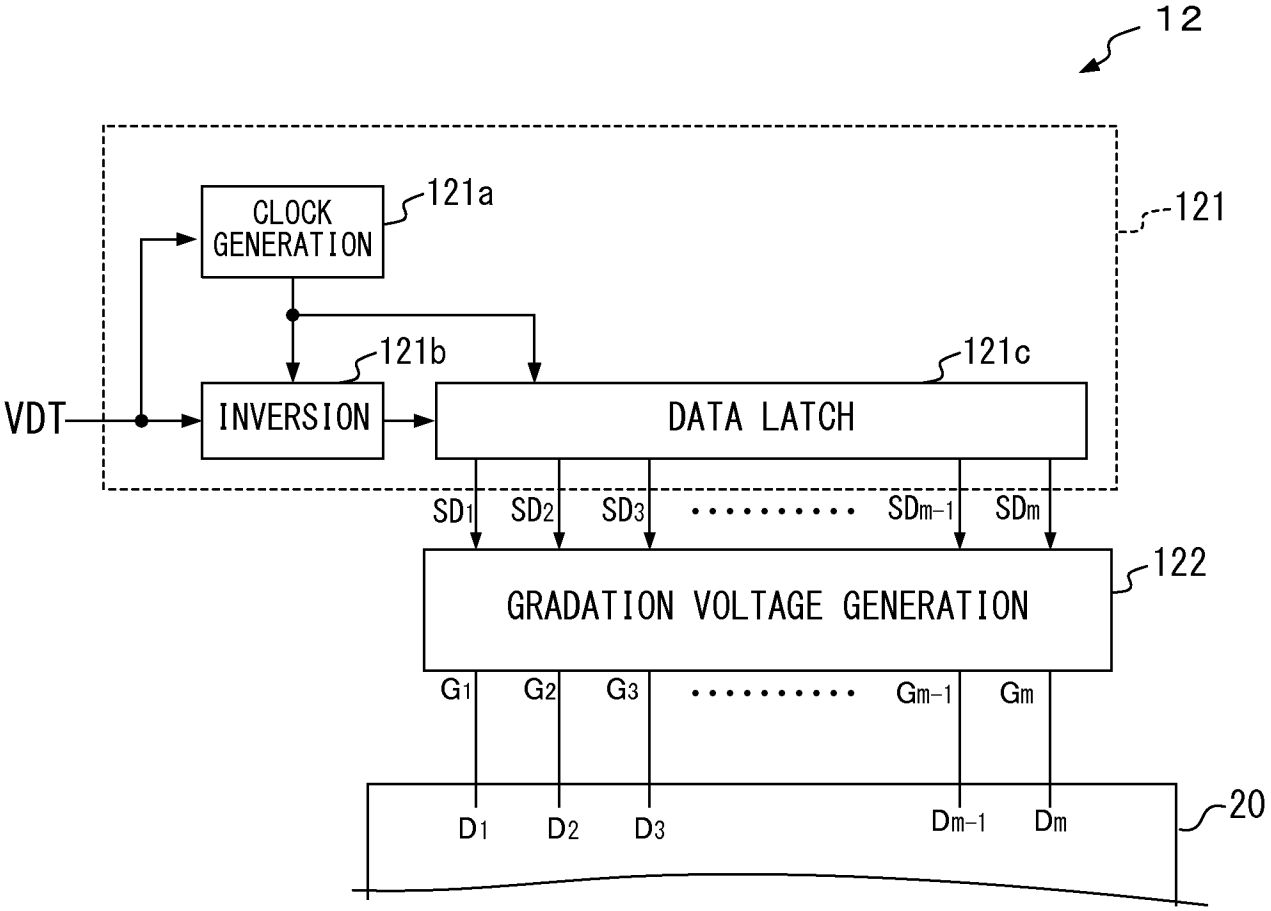
FIG. 4 is a block diagram illustrating an internal configuration of a data driver 12.

The data driver 12 is formed in a single semiconductor chip or formed dispersedly in a plurality of semiconductor chips. As shown in FIG. 4, the data driver 12 includes a data reception and take-in unit 121 and a gradation voltage generating unit 122.

The data reception and take-in unit 121 receives the transmission image data signal VDT transmitted from the drive control unit 10.

A clock generating unit 121*a* of the data reception and take-in unit 121 detects the clock data CD included in each unit transmission block DB in the transmission image data signal VDT. The clock generating unit 121*a* then generates a clock signal having a frequency for taking in data, which is phase-synchronized with the rear edge of the clock data CD. The clock generating unit 121*a* supplies the clock signal to an inverting unit 121*b* and a data latch 121*c*.

On the basis of the inversion flag FLG included in each unit transmission block DB in the received transmission image data signal VDT, the inverting unit 121*b* performs logic level inversion processing on the pixel data $PD_R$, $PD_G$, and $PD_B$ included in the unit transmission block DB. More specifically, if the inversion flag FLG indicates the logic level 1, the inverting unit 121*b* inverts the logic levels of all bits in the pixel data $PD_R$, $PD_G$, and $PD_B$ and supplies the inverted pixel data to the data latch 121*c* at the timing of the clock signal. If the inversion flag FLG indicates the logic level 0, the inverting unit 121*b* directly supplies the pixel data $PD_R$, $PD_G$, and $PD_B$ included in the unit transmission block DB to the data latch 121*c* at the timing of the clock signal without performing logic level inversion processing thereon.

The data latch 121*c* sequentially takes in the pixel data $PD_R$, $PD_G$, and $PD_B$ sequentially supplied via the inverting unit 121*b* at the timing in accordance with the clock signal. Every time taking in of the pixel data for one horizontal scanning line, i.e., m pieces of pixel data ($PD_R$, $PD_G$, and $PD_B$) is completed, the data latch 121*c* supplies pixel data $SD_1$ to $SD_m$ corresponding to the m pieces of pixel data to the gradation voltage generating unit 122.

The gradation voltage generating unit 122 converts the pixel data $SD_1$ to $SD_m$ to analog gradation voltages corresponding to luminance levels indicated by the pixel data $SD_1$ to $SD_m$, respectively. The gradation voltage generating unit 122 then applies the gradation voltages corresponding to the pixel data $SD_1$ to $SD_m$ to the data lines $D_1$ to $D_m$ in the display panel 20 as pixel driving voltages $G_1$ to $G_m$.

An operation of generating and transmitting the transmission image data signal VDT by the drive control unit 10 will now be described below taking a case where the clock data CD has a positive pulse as an example.

Figure 5:
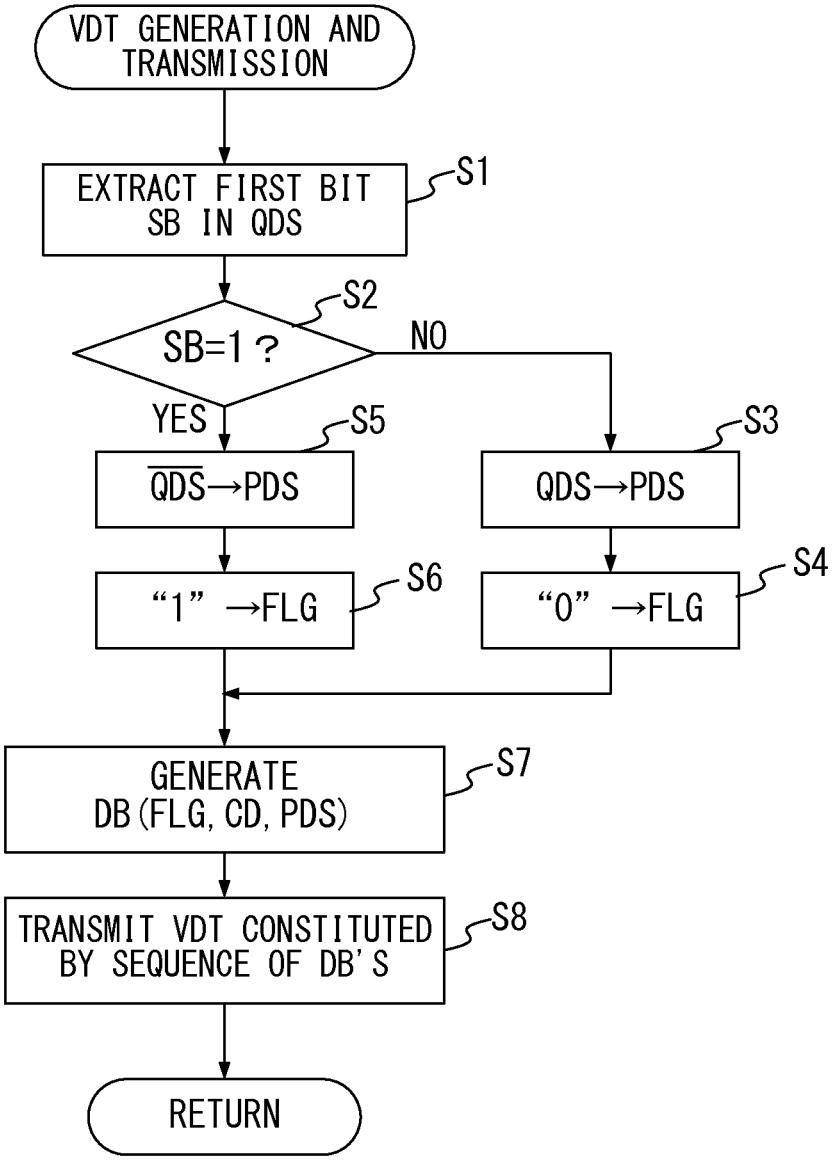
FIG. 5 is a flow chart illustrating a procedure of control for generating and transmitting the transmission image data signal VDT.

The drive control unit 10 performs control in accordance with a procedure for generating and transmitting the transmission image data signal VDT shown in FIG. 5.

In FIG. 5, the drive control unit 10 first extracts, for each pixel data block QDS in the input image data VD shown in FIG. 2, the first bit in the pixel data block QDS as a first bit SB (step S1). For example, in FIG. 2, the drive control unit 10 extracts, for each pixel data block QDS, the first bit of the pixel data $QD_R$ as the first bit SB.

Next, for each pixel data block QDS, the drive control unit 10 determines whether the first bit SB is at the logic level 1 same as the logic level of the clock data CD (step S2). In other words, the drive control unit 10 determines in the step S2 whether data transition has occurred at a boundary between the clock data CD and the head of the pixel data block QDS.

If it is determined in the step S2 that the first bit SB is not at the logic level 1, the drive control unit 10 uses the pixel data $QD_R$, $QD_G$, and $QD_B$ contained in the pixel data block QDS as the pixel data $PD_R$, $PD_G$, and $PD_B$ without performing any processing thereon, and sets the pixel data block PDS constituted by these pixel data $PD_R$, $PD_G$, and $PD_B$ (step S3). In other words, if it is determined in the step S2 that data transition has occurred at the boundary between the clock data CD and the head of the pixel data block QDS, the pixel data QD contained in the pixel data block QDS are used as the pixel data PD without being processed and the pixel data block PDS constituted by such pixel data PD is set in the step S3.

After the step S3 is carried out, the drive control unit 10 sets the inversion flag FLG at the logic level 0 to indicate that no logic level inversion processing has been performed (step S4).

If it is determined in the step S2 that the first bit SB is at the logic level 1, the drive control unit 10 sets those obtained by inverting the logic levels of all bits (24 bits) in the pixel data $QD_R$, $QD_G$, and $QD_B$ contained in the pixel data block QDS as the pixel data $PD_R$, $PD_G$, and $PD_B$, and sets the pixel data block PDS constituted by these pixel data $PD_R$, $PD_G$, and $PD_B$ (step S5). In other words, if it is determined in the step S2 that no data transition has occurred at the boundary between the clock data CD and the head of the pixel data block QDS, those obtained by inverting the logic levels of all bits in the pixel data QD contained in the pixel data block QDS are set as the pixel data PD, and the pixel data block PDS constituted by such pixel data PD is set in the step S5.

After the step S5 is carried out, the drive control unit 10 sets the inversion flag FLG at the logic level 1 to indicate that the logic level inversion processing has been performed (step S6).

After the step S4 or S6 is carried out, the drive control unit 10 generates the unit transmission block DB by adding the clock data CD at the logic level 1, formed by a positive pulse of the 1-bit period BT, between the set inversion flag FLG and the pixel data block PDS (step S7).

Next, the drive control unit 10 transmits the transmission image data signal VDT in which the unit transmission blocks DB, each generated every pixel data block QDS, are consecutively or contiguously arranged to the data driver 12 (step S8).

Figure 6:
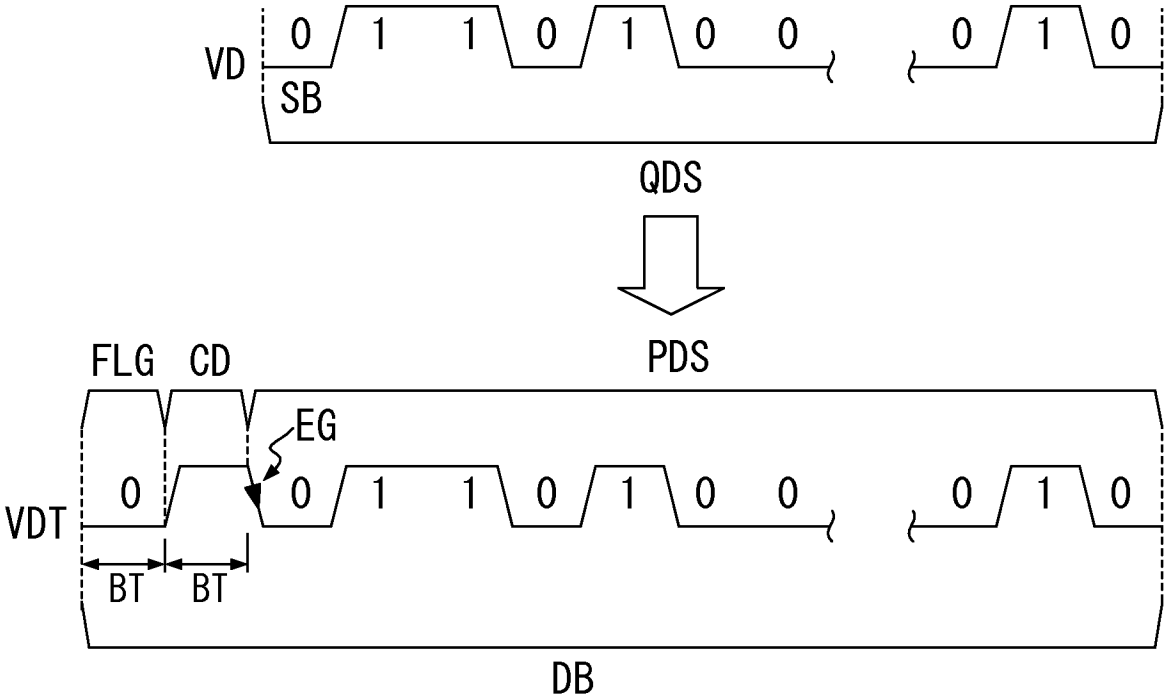
FIG. 6 is a diagram illustrating an example of the transmission image data signal VDT when clock data CD has a positive pulse and an inversion flag is at a logic level 0.

According to the control for generating and transmitting the transmission image data signal VDT shown in FIG. 5, the drive control unit 10 generates the unit transmission block DB as shown in FIG. 6 for the pixel data block QDS having the first bit SB at the logic level 0. In other words, if data transition has occurred at the boundary between the clock data CD and the head of the pixel data block QDS, the steps S3, S4, and S7 are carried out. As a result, the unit transmission block DB, constituted by the inversion flag FLG at the logic level 0, the clock data CD formed by a positive pulse, and the pixel data block PDS having the same bit group as the pixel data block QDS, is generated as shown in FIG. 6.

Figure 7:
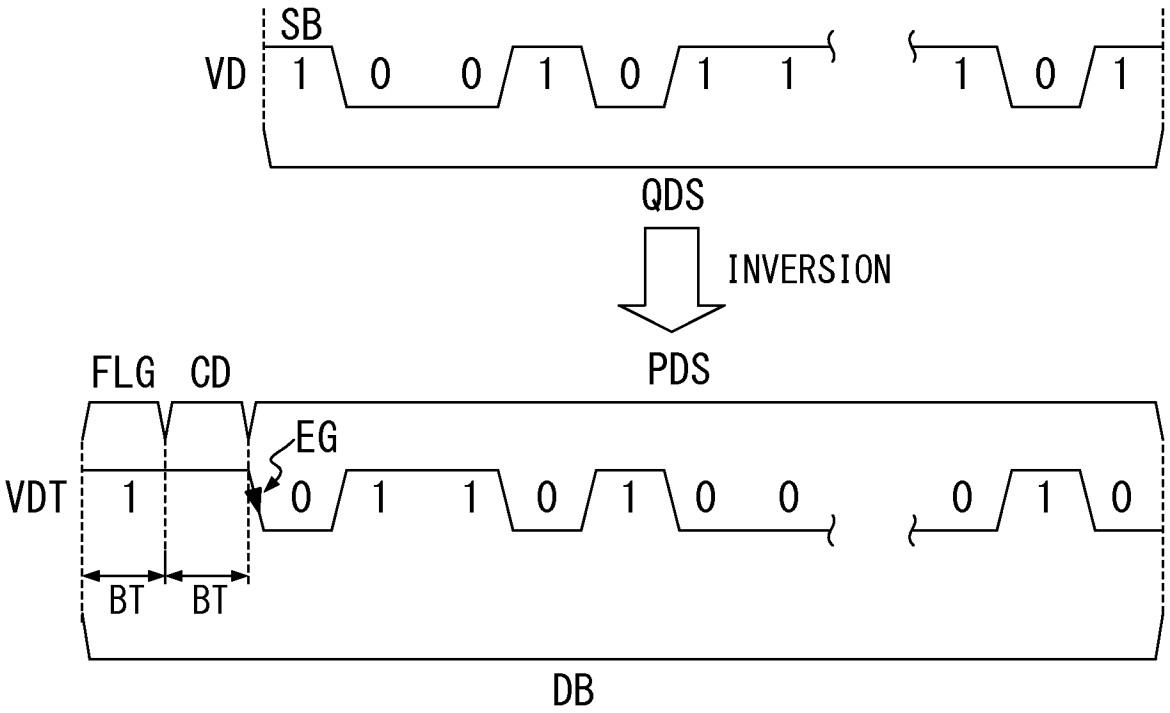
FIG. 7 is a diagram illustrating an example of the transmission image data signal VDT when the clock data CD has a positive pulse and the inversion flag is at a logic level 1.

If the first bit SB is at the logic level 1, i.e., if no data transition has occurred at the boundary between the clock data CD and the head of the pixel data block QDS, the drive control unit 10 generates the unit transmission block DB as shown in FIG. 7. In other words, as a result of carrying out the steps S5 to S7, the unit transmission block DB, constituted by the inversion flag FLG at the logic level 1, the clock data CD formed by a positive pulse, and the pixel data block PDS having a bit group obtained by inverting the logic levels of all bits in the pixel data block QDS, is generated as shown in FIG. 7.

The drive control unit 10 then transmits the transmission image data signal VDT in which the thus-generated unit transmission blocks DB are consecutively arranged to the data driver 12.

An operation of receiving and taking in the transmission image data signal VDT by the data reception and take-in unit 121 of the data driver 12 will now be described below.

Upon receiving the transmission image data signal VDT, the clock generating unit 121*a* of the data reception and take-in unit 121 extracts the clock data CD shown in FIG. 6 or 7 from the transmission image data signal VDT. The clock generating unit 121*a* then generates a clock signal phase-synchronized with a rear edge EG of the clock data CD.

Figure 8:
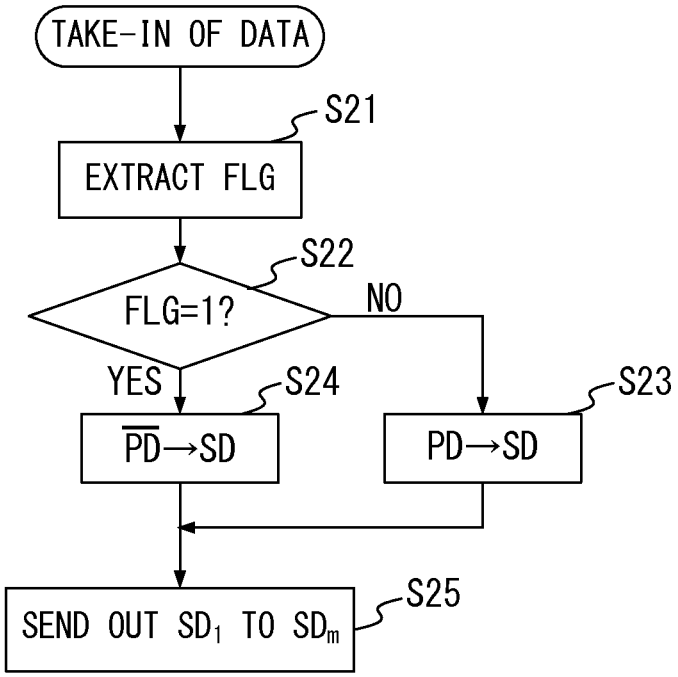
FIG. 8 is a flow chart illustrating a procedure for a data take-in operation.

In accordance with a data take-in procedure shown in FIG. 8, the inverting unit 121*b* and the data latch 121*c* of the data reception and take-in unit 121 take in the pixel data PD included in the transmission image data signal VDT at the timing synchronized with the clock signal.

As shown in FIG. 8, the inverting unit 121*b* of the data reception and take-in unit 121 first extracts the inversion flag FLG from the unit transmission block DB in the transmission image data signal VDT (step S21). Next, the inverting unit 121*b* determines, for each unit transmission block DB, whether the inversion flag FLG is at the logic level 1 which indicates that the logic level inversion processing has been performed (step S22).

If it is determined in the step S22 that the inversion flag FLG is not at the logic level 1, the inverting unit 121*b* takes in the pixel data $PD_R$, $PD_G$, and $PD_B$ contained in the pixel data block PDS from the unit transmission block DB at the timing of the clock signal. The inverting unit 121*b* supplies these pixel data to the data latch 121*c*. The data latch 121*c* sequentially takes in each of the pixel data $PD_R$, $PD_G$, and $PD_B$ as the 8-bit parallel pixel data SD at the timing of the clock signal (step S23).

If it is determined in the step S22 that the inversion flag FLG is at the logic level 1, the inverting unit 121*b* takes in the pixel data $PD_R$, $PD_G$, and $PD_B$ contained in the pixel data block PDS from the unit transmission block DB at the timing of the clock signal. The inverting unit 121*b* supplies those obtained by inverting the logic levels of all bits in these pixel data $PD_R$, $PD_G$, and $PD_B$ to the data latch 121*c*. The data latch 121*c* sequentially takes in each of the pixel data $PD_R$, $PD_G$, and $PD_B$, which have been subjected to the above inversion processing, as the 8-bit parallel pixel data SD at the timing of the clock signal (step S24).

Once the taking-in of the m pieces of pixel data $SD_1$ to $SD_m$ corresponding to one horizontal scanning line is completed by carrying out the above step S23 or S24, the data latch 121*c* sends out these pixel data $SD_1$ to $SD_m$ to the gradation voltage generating unit 122 (step S25).

In this manner, the data reception and take-in unit 121 determines, on the basis of the inversion flag FLG included in the unit transmission block DB, whether the pixel data $PD_R$, $PD_G$, and $PD_B$ included in the unit transmission block DB have been subjected to the logic level inversion processing for each unit transmission block DB (step S22). If no logic level inversion processing has been performed, the pixel data $PD_R$, $PD_G$, and $PD_B$ are supplied as they are to the gradation voltage generating unit 122 as three pieces of pixel data SD (steps S23 and S25). If the logic level inversion processing has been performed, the logic levels of all bits in the pixel data $PD_R$, $PD_G$, and $PD_B$ are inverted so as to restore the original pixel data $QD_R$, $QD_G$, and $QD_B$ presented by the input image data VD. The data reception and take-in unit 121 then sends out these restored pixel data to the gradation voltage generating unit 122 as the pixel data SD (steps S24 and S25).

As described above, according to the display device shown in FIG. 1, when transmitting the image data signal on which the data for clock recognition is superimposed to the data driver 12, the drive control unit 10 generates the transmission image data signal VDT as described below. More specifically, for each unit transmission block DB having the pixel data block PDS containing the pixel data $PD_R$, $PD_G$, and $PD_B$, the drive control unit 10 adds the clock data CD contiguously to the head of the pixel data block PDS and adds the inversion flag FLG immediately before the clock data CD. If no data transition has occurred at the boundary between the clock data CD and the pixel data block PDS, pixel data obtained by inverting the logic levels of the original pixel data QD provided as the input image data are set as the pixel data PD. If the data transition has occurred, the original pixel data QD are set as the pixel data PD without being processed. The drive control unit 10 sets information which indicates whether the above logic level inversion processing has been performed on the pixel data pieces as the above inversion flag.

The drive control unit 10 generates the transmission image data signal VDT in which the thus-formed unit transmission blocks DB are consecutively arranged and sends the transmission image data signal VDT to the data driver 12.

This causes the rear edge EG for clock recognition to always appear at the boundary between the clock data CD and the head of the pixel data block PDS and allows the data driver 12 on the receiver side to restore the original pixel data pieces on the basis of the inversion flag FLG.

Thus, according to the present invention, the image data signal on which the clock data is superimposed can be transmitted at high speed since it is only necessary to add, for each unit transmission block DB, the inversion flag FLG and the clock data CD each for the 1-bit period BT.

In the above embodiment, if no data transition has occurred between the clock data CD and the first bit SB of the pixel data block QDS, the pixel data block PDS is formed by those obtained by inverting the logic levels of all bits in the pixel data $QD_R$, $QD_G$, and $QD_B$ contained in the pixel data block QDS. In such a case, however, only the logic level of at least the first bit in the pixel data block QDS may be inverted.

Figure 9:
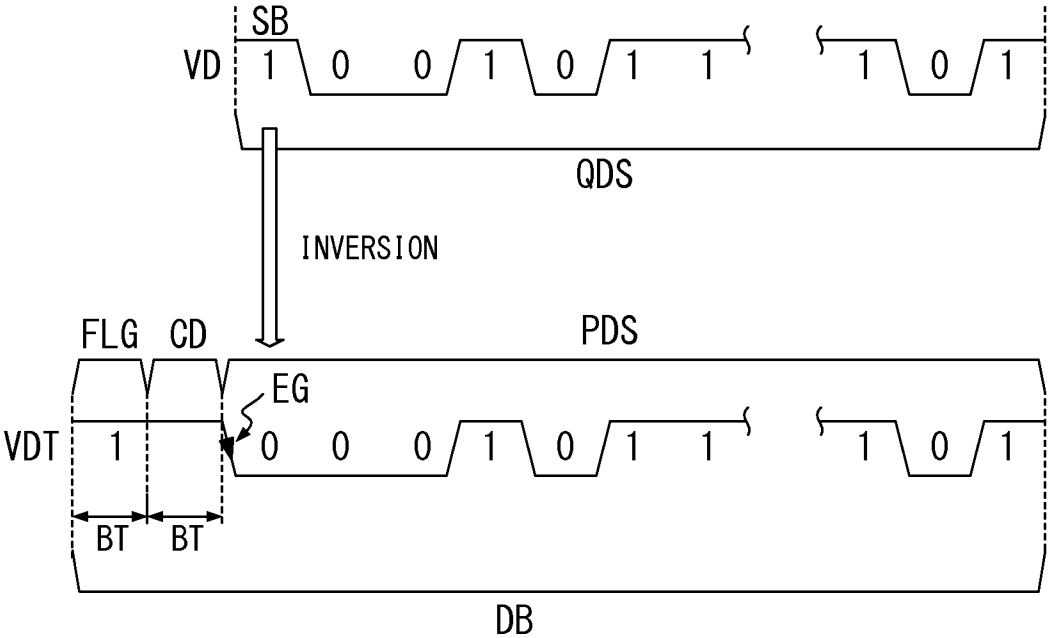
FIG. 9 is a diagram illustrating another example of the transmission image data signal VDT when the inversion flag is at the logic level 1.

For example, if the first bit SB of the pixel data $QD_R$ positioned at the head of the pixel data block QDS is at the logic level 1 as shown in FIG. 9, the pixel data block PDS is formed by inverting only the logic level of the first bit SB and keeping the logic levels of the remaining 23 bits unchanged. In the inverting unit 121*b* of the data reception and take-in unit 121, only the logic level of the first bit SB in the pixel data block PDS is inverted if the inversion flag FLG is at the logic level 1.

In the above embodiment, the pixel data block PDS is constituted by the three pieces of pixel data $PD_R$, $PD_G$, and $PD_B$ corresponding to one pixel as shown in FIG. 3. However, the number of pixel data pieces PD included in each unit transmission block DB is not limited to three. The unit transmission block DB may include one piece or two or more pieces of pixel data PD.

Figure 10:
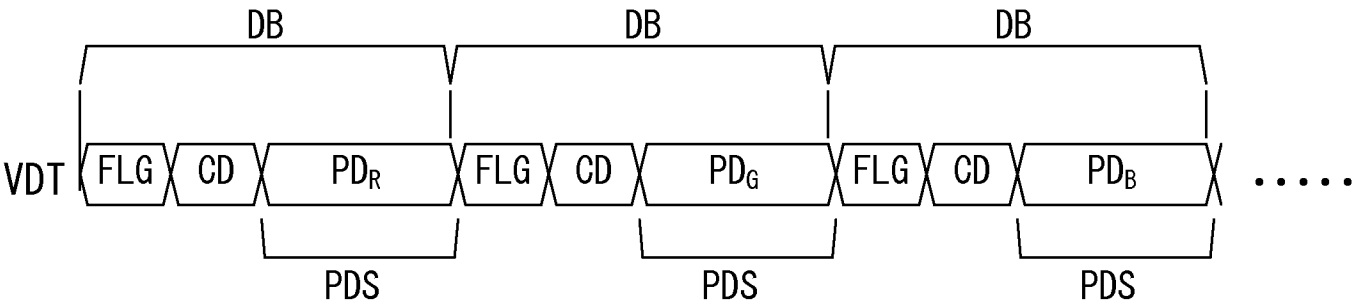
FIG. 10 is a diagram illustrating another example of the format of the transmission image data signal VDT.

For example, the pixel data block PDS may be constituted by a single piece of pixel data PD as shown in FIG. 10. More specifically, the clock data CD and the inversion flag FLG are added contiguously to each head of the pixel data $PD_R$, $PD_G$, and $PD_B$ to each form a single unit transmission block DB as shown in FIG. 10.

Figure 11:
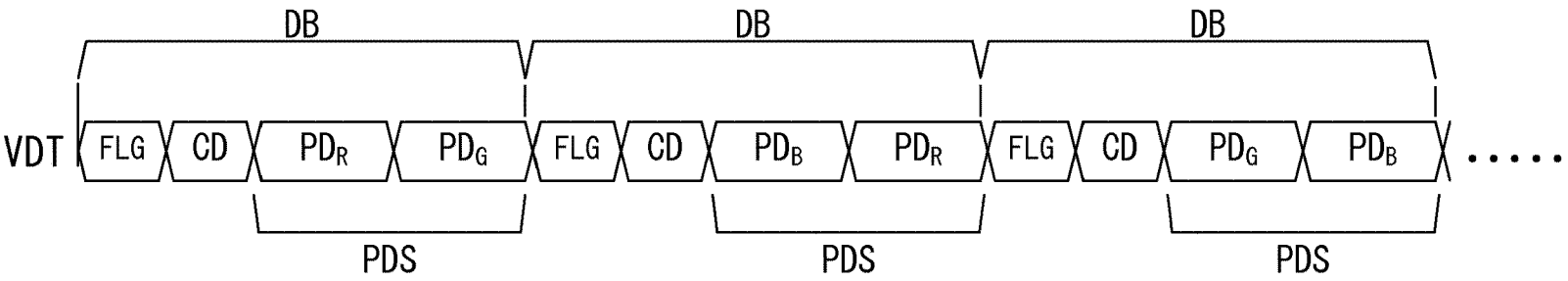
FIG. 11 is a diagram illustrating still another example of the format of the transmission image data signal VDT.

As shown in FIG. 11, the pixel data block PDS may be formed by two pieces of pixel data PD. More specifically, the sequence of the pixel data $PD_R$, $PD_G$, and $PD_B$ in the input image data VD is separated every two pieces of pixel data PD adjacent to each other. The clock data CD and the inversion flag FLG are added contiguously to the head of such a pair of pixel data pieces PD to form a single unit transmission block DB.

Furthermore, the above logic level inversion processing on the pixel data as shown in FIG. 7 or 9 may be performed with the data format shown in FIG. 10 or 11.

Figure 12:
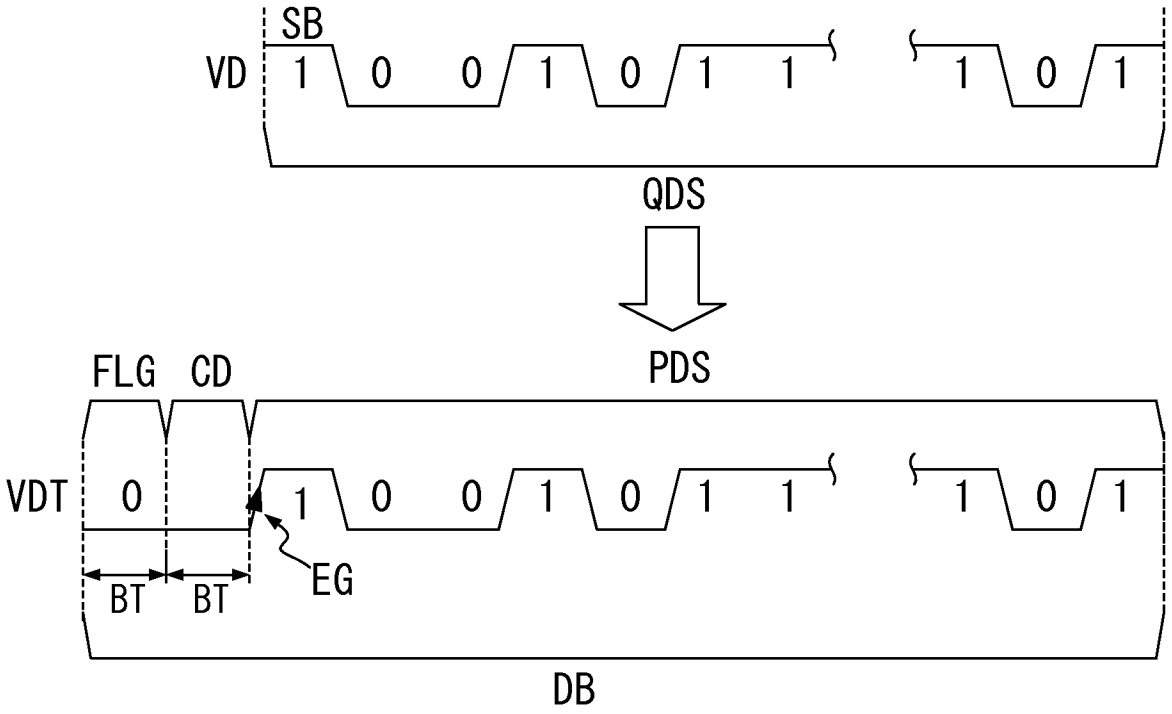
FIG. 12 is a diagram illustrating an example of the transmission image data signal VDT when the clock data CD has a negative pulse and the inversion flag is at the logic level 0.
Figure 13:
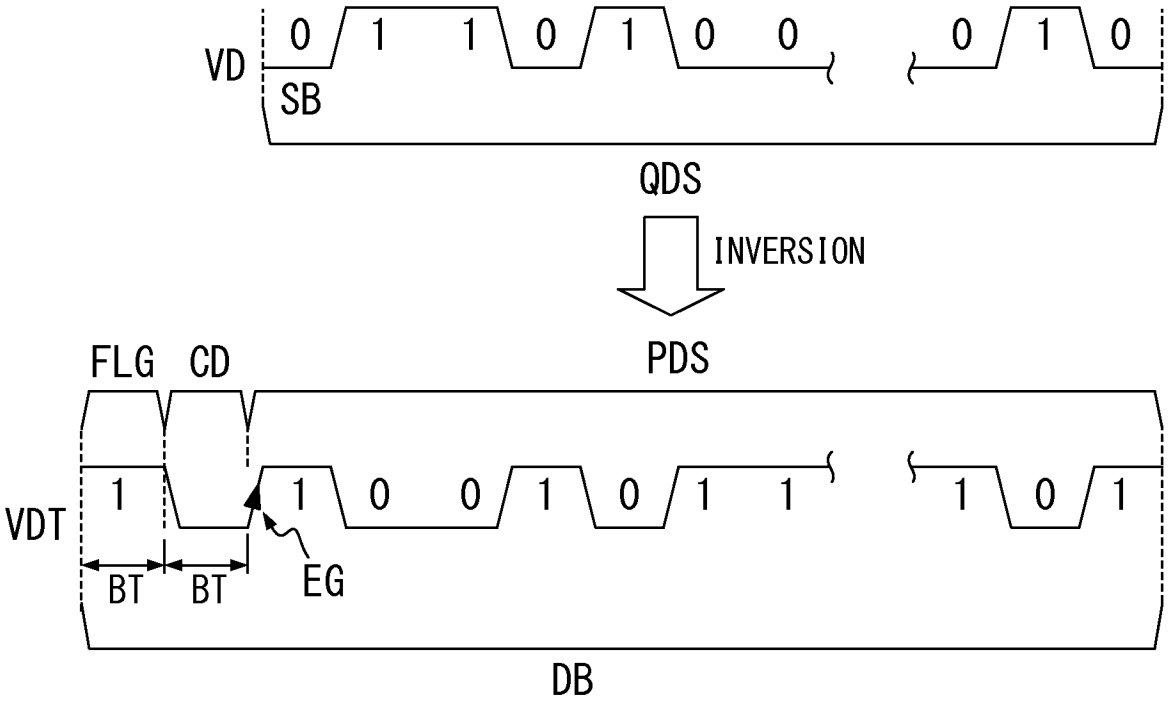
FIG. 13 is a diagram illustrating an example of the transmission image data signal VDT when the clock data CD has a negative pulse and the inversion flag is at the logic level 1.

Although the clock data CD is a positive pulse corresponding to the logic level 1 in the above embodiment, the clock data CD may be a negative pulse corresponding to the logic level 0 as shown in FIGS. 12 and 13.

As shown in FIG. 12, if the first bit SB of the pixel data block QDS in the input image data VD is at the logic level 1, which is different from the pulse of the clock data CD, the drive control unit 10 allows the pixel data block QDS to be included in the unit transmission block DB as the pixel data block PDS without performing any processing thereon.

On the other hand, as shown in FIG. 13, if the first bit SB of the pixel data block QDS is at the logic level 0, which is the same as the pulse of the clock data CD, the drive control unit 10 causes those obtained by inverting the logic levels of all bits in the pixel data block QDS to be included in the unit transmission block DB as the pixel data block PDS.

In sum, the drive control unit (10) generates, as follows, the transmission image data signal (VDT) in which the unit transmission blocks (DB), each having the pixel data block (PDS) including at least one pixel data piece in the sequence of the pixel data pieces (QD) included in the input image data signal (VD), are consecutively arranged. The drive control unit (10) then transmits the transmission image data signal (VDT) to the driver (12).

More specifically, the drive control unit adds the clock data (CD) continuously to the head of the above pixel data block for each of the unit transmission blocks (step S7). The drive control unit determines whether data transition has occurred at the boundary between the clock data and the head of the pixel data block (step S2). Only if it is determined that no data transition has occurred, the drive control unit inverts the logic level of the pixel data piece included in the pixel data block (step S5). The drive control unit further adds the inversion flag (FLG) which indicates whether the logic level inversion processing has been performed on the pixel data piece included in this pixel data block immediately before the clock data (steps S4 and S6).

Upon receiving the transmission image data signal (VDT), the driver (12) generates the clock signal phase-synchronized with the clock data included in this transmission image data signal (121*a*). If the inversion flag included in the received transmission image data signal indicates that the inversion processing has been performed, the driver takes in and outputs the resultant obtained by inverting the logic level of the pixel data piece included in this transmission image data signal in accordance with the above clock signal (121*b* and 121*c*). On the other hand, if the inversion flag indicates that no inversion processing has been performed, the driver takes in and outputs the above pixel data piece in accordance with the clock signal (121*b* and 121*c*). The thus-output pixel data pieces are converted to the pixel driving voltages (G), and the pixel driving voltages (G) are applied to the data lines (D) in the display panel (20).

This application is based on a Japanese Patent Application No. 2014-183067 which is hereby incorporated by reference.

What is claimed is:

1. A display device for displaying an image based on input image data including a sequence of pixel data pieces each indicating a luminance level of a pixel, the display device comprising:

a driver for applying pixel driving voltages to a plurality of data lines formed in a display panel; and a control unit for generating a transmission image data signal in which unit transmission blocks, each having a pixel data block including at least one of the pixel data pieces in the sequence of the pixel data pieces in the input image data, are consecutively arranged and transmitting the transmission image data signal to the driver, wherein the control unit includes:

a first processing unit for adding clock data contiguously to a head of the pixel data block for each of the unit transmission blocks;

a second processing unit for determining whether data transition has occurred at a boundary between the clock data and the pixel data block;

a third processing unit for inverting a logic level of the at least one of the pixel data pieces included in the pixel data block if it is determined that the data transition has not occurred; and a fourth processing unit for adding an inversion flag that indicates whether logic level inversion processing has been performed on the at least one of the pixel data pieces included in the pixel data block immediately before the clock data, and the driver includes:

a clock generating unit for generating a clock signal phase-synchronized with a rear edge of the clock data included in the transmission image data signal received;

a data take-in unit for taking in and outputting a resultant obtained by inverting a logic level of the at least one of the pixel data pieces included in the transmission image data signal received in accordance with the clock signal if the inversion flag included in the transmission image data signal received indicates that the inversion processing has been performed, and taking in and outputting the at least one of the pixel data pieces in accordance with the clock signal if the inversion flag indicates that the inversion processing has not been performed; and a gradation voltage generating unit for converting the pixel data pieces output from the data take-in unit to the pixel driving voltages.

2. The display device according to claim 1, wherein the third processing unit inverts logic levels of all bits in the at least one of the pixel data pieces included in the pixel data block if it is determined that the data transition has not occurred, and the data take-in unit inverts logic levels of the all bits in the at least one of the pixel data pieces if the inversion flag indicates that the inversion processing has been performed.

3. The display device according to claim 1, wherein the third processing unit inverts only a logic level of a first bit in a pixel data piece included at the head of the pixel data block if it is determined that the data transition has not occurred, and the data take-in unit inverts only a logic level of the first bit in the pixel data piece included at the head of the pixel data block if the inversion flag indicates that the inversion processing has been performed.

4. The display device according to claim 1, wherein the second processing unit determines that the data transition has not occurred if a logic level of the clock data and a logic level of a first bit of the pixel data block are identical to each other, and determines that the data transition has occurred if the logic level of the clock data and the logic level of the first bit are different from each other.

5. The display device according to claim 1, wherein the sequence of the pixel data pieces includes a first pixel data piece indicating a red luminance level, a second pixel data piece indicating a green luminance level, and a third pixel data piece indicating a blue luminance level, and the pixel data block is constituted by the first to third pixel data pieces.

6. The display device according to claim 1, wherein the sequence of the pixel data pieces includes a first pixel data piece indicating a red luminance level, a second pixel data piece indicating a green luminance level, and a third pixel data piece indicating a blue luminance level, and the pixel data block is constituted by two pixel data pieces out of the first to third pixel data pieces.

7. A display panel driver for receiving an image data signal in which unit transmission blocks, each having a pixel data block including at least one pixel data piece indicating a luminance level of a pixel, are consecutively arranged and driving a display panel based on the image data signal received, wherein clock data is added contiguously to a head of the pixel data block in each of the unit transmission blocks, and an inversion flag that indicates whether logic level inversion processing has been performed on the at least one pixel data piece is added immediately before the clock data, and the driver includes:

a clock generating unit for generating a clock signal phase-synchronized with the clock data included in the image data signal received;

a data take-in unit for taking in and outputting a resultant obtained by inverting a logic level of the at least one pixel data piece included in the image data signal received in accordance with the clock signal if the inversion flag included in the image data signal received indicates that the inversion processing has been performed, and taking in and outputting the at least one pixel data piece in accordance with the clock signal if the inversion flag indicates that the inversion processing has not been performed; and a gradation voltage generating unit for converting the pixel data pieces output from the data take-in unit to pixel driving voltages and applying the pixel driving voltages to a plurality of data lines in the display panel.

8. The display panel driver according to claim 7, wherein the data take-in unit inverts logic levels of all bits in the at least one pixel data piece if the inversion flag indicates that the inversion processing has been performed.

9. The display panel driver according to claim 7, wherein the data take-in unit inverts only a logic level of a first bit in a pixel data piece included at the head of the pixel data block if the inversion flag indicates that the inversion processing has been performed.

10. The display panel driver according to claim 7, wherein the sequence of the pixel data pieces includes a first pixel data piece indicating a red luminance level, a second pixel data piece indicating a green luminance level, and a third pixel data piece indicating a blue luminance level, and the pixel data block is constituted by the first to third pixel data pieces.

11. The display panel driver according to claim 7, wherein the sequence of the pixel data pieces includes a first pixel data piece indicating a red luminance level, a second pixel data piece indicating a green luminance level, and a third pixel data piece indicating a blue luminance level, and the pixel data block is constituted by two out of the first to third pixel data pieces.

12. An image data signal transmission method for transmitting a transmission image data signal to a display panel driver based on input image data including a sequence of pixel data pieces indicating a luminance level of a pixel, the method comprising:

a first step of determining, for each unit transmission block including a pixel data block including at least one of the pixel data pieces in the sequence of the pixel data pieces in the input image data and clock data contiguously added to a head of the pixel data block, whether data transition has occurred at a boundary between the clock data and the pixel data block;

a second step of inverting a logic level of the at least one of the pixel data pieces included in the pixel data block if it is determined that the data transition has not occurred;

a third step of adding an inversion flag immediately before the clock data, the inversion flag indicating whether logic level inversion processing has been performed on the at least one of the pixel data pieces included in the pixel data block; and a fourth step of transmitting the transmission image data signal in which unit transmission blocks each including the inversion flag are consecutively arranged to the display panel driver.

13. The image data signal transmission method according to claim 12, wherein the second step inverts logic levels of all bits in the at least one of the pixel data pieces included in the pixel data block if it is determined that the data transition has not occurred.

14. The image data signal transmission method according to claim 12, wherein the second step inverts only a logic level of a first bit in a pixel data piece included at the head of the pixel data block if it is determined that the data transition has not occurred.

15. The image data signal transmission method according to claim 12, wherein the first step determines that the data transition has not occurred if a logic level of the clock data and a logic level of a first bit of the pixel data block are identical to each other, and determines that the data transition has occurred if the logic level of the clock data and the logic level of the first bit are different from each other.

16. The image data signal transmission method according to claim 12, wherein the sequence of the pixel data pieces includes a first pixel data piece indicating a red luminance level, a second pixel data piece indicating a green luminance level, and a third pixel data piece indicating a blue luminance level, and the pixel data block is constituted by the first to third pixel data pieces.

17. The image data signal transmission method according to claim 12, wherein the sequence of the pixel data pieces includes a first pixel data piece indicating a red luminance level, a second pixel data piece indicating a green luminance level, and a third pixel data piece indicating a blue luminance level, and the pixel data block is constituted by two out of the first to third pixel data pieces.

* * * * *